US006653918B1

(12) United States Patent
Johnson

(10) Patent No.: US 6,653,918 B1
(45) Date of Patent: Nov. 25, 2003

(54) OPERATING MECHANISM FOR AUTORECLOSER WITH SERIES DISCONNECTOR

(75) Inventor: Kenneth Joseph Johnson, Manchester (GB)

(73) Assignee: Alstom UK Ltd., Rugby (GB)

( * ) Notice: Subject to any disclaimer, the term of this patent is extended or adjusted under 35 U.S.C. 154(b) by 0 days.

(21) Appl. No.: 09/744,725

(22) PCT Filed: May 26, 2000

(86) PCT No.: PCT/GB00/02058

§ 371 (c)(1),
(2), (4) Date: Apr. 24, 2001

(87) PCT Pub. No.: WO00/74095

PCT Pub. Date: Dec. 7, 2000

(30) Foreign Application Priority Data

Jun. 1, 1999 (GB) ..... 9912651

(51) Int. Cl.[7] ..... H01H 3/00
(52) U.S. Cl. ..... 335/68; 218/120; 218/154
(58) Field of Search ..... 335/68–74; 218/120, 218/140, 152, 154

(56) References Cited

U.S. PATENT DOCUMENTS 3,390,239 A 6/1968 Miller
3,601,565 A * 8/1971 Few ..... 218/43

FOREIGN PATENT DOCUMENTS

DE 33 12 661 A1 10/1984
DK 976 422 8/1963
GB 2 175 447 A 11/1986
GB 2 175 448 A 11/1986
GB 2 281 151 A 2/1995
JP 1-267920 * 1/1989

* cited by examiner

*Primary Examiner*—Lincoln Donovan
(74) *Attorney, Agent, or Firm*—Kirschstein, et al.

(57) ABSTRACT

An operating mechanism for an autorecloser provides an improved form of mechanical interlock between the circuit breaker element (3) of an autorecloser and a disconnector (2) in electrical series with it A shaft (82) transmits linear motion between the circuit breaker's moveable contact and the profile of a bell crank (50), the bell crank being attached to a link (70) for manual rotation of the bell crank and also to a link (60) for moving a moveable contact (20) of the disconnector between CLOSED and OPEN positions. The geometry of the bell crank profile and linkages is such that when the bell crank is rotated clockwise through an angle X from a starting position in which the moveable contacts of both the circuit breaker and the disconnector are in the CLOSED position, the moveable contact of the circuit breaker is moved to an OPEN position while the moveable contact (20) of the disconnector is maintained CLOSED. During further clockwise rotation of the bell crank (50) through a further set angle Z to a predetermined limit of movement of the bell crank, the moveable contact (20) of the disconnector is moved to an OPEN position while the moveable contact of the circuit breaker is maintained in the OPEN position by a sector of the bell crank profile (59) which is of constant radius R2. When the bell crank (50) is rotated back to its starting position, the moveable contact (20) of the disconnector is moved back to its CLOSED position before the moveable contact of the circuit breaker is moved back to its CLOSED position.

11 Claims, 3 Drawing Sheets

OPERATING MECHANISM FOR AUTORECLOSER WITH SERIES DISCONNECTOR

BACKGROUND OF THE INVENTION

The present invention relates to control of power in overhead line electrical distribution systems and in particular to an operating mechanism for mechanically interlocking the circuit-breaker element of an autorecloser with an associated disconnector to prevent on-load operation of the disconnector.

Autoreclosers of the type referred to in this specification are intended to be mounted on electricity distribution poles and pylons in overhead line electrical distribution systems. Pole mounted Autoreclosers are in effect, pole mounted circuit breakers connected to control the power flowing in overhead lines. Systems of this type are prone to electrical faults of a transient nature, due to wind blown foliage, birds and lightning strikes Therefore Autoreclosers, as their name suggests, are arranged to open and clear fault current when it reaches a predetermined level, and then reclose after a pre-deteried time interval. In cases where the electrical fault, which causes the autorecloser to open, self-clears during the cessation of current, safe power supply is re-established when the unit recloses. However. Autoreclosers are designed to remain in the open position, preventing further electrical current flow, when they have experienced the passage of a pre-determined number of electrical fault currents in a pre-determined sequence of operations. These sequences are usually a selection of instantaneous and fault current dependent time opening operations. When an autorecloser has exhausted its pre-set sequence the fault is deemed to be permanent and it is said to have 'locked-out' in the OPEN position. The system then requires manual intervention to carry out repairs at the site of the fault.

When repairs are to be carried out to the overhead line, operator safety dictates that the line be isolated from the system by the use of a disconnector and i live-line working is not to be employed, the faulted section is earthed. These disconnectors are off-load switching devices They provide an isolating gap between their contacts capable of withstanding a much higher impulse voltage level than the impulse voltage which the overhead line itself can withstand, and so provide protection from electrical flashover of one side of the overhead line system to the other. As these are off-load switching devices they have to be interlocked with the circuit-breaker element of the autorecloser to prevent on-load operation.

SUMMARY OF THE INVENTION

The present invention provides an improved form of mechanical interlock between the circuit breaker element of an autorecloser and a disconnector.

According to the present invention, an operating mechanism for an autorecloser, in which a circuit breaker is in electrical series with a disconnector, comprises shaft means for transmitting motion between first and second ends thereof, the first end being connected to the circuit breaker for moving a moveable contact of the circuit breaker between CLOSED and OPEN positions, the second end being, adapted to engage a profile of a rotary crank means, the rotary crank means being attached to means for rotating it the rotary crank means being further attached to an insulating linkage for moving a moveable contact of the disconnector between CLOSED and OPEN positions, the arrangement being such that when the rotary crank means is rotated in a predetermined direction through a first predetermined angle from a starting position in which the moveable contacts of the circuit breaker and the disconnector are both in the CLOSED position, the moveable contact of the circuit breaker is moved to an OPEN position while the moveable contact of the disconnector is maintained in the CLOSED position and during further rotation of the rotary crank means in the first direction through a second predetermined angle. the moveable contact of the disconnector is moved to an OPEN position while the moveable contact of the circuit breaker is maintained in the OPEN position and further that when the rotary crank means is rotated back to its starting position. the moveable contact of the disconnector is moved back to its CLOSED position before the moveable contact of the circuit breaker is moved back to its CLOSED position.

In order to move the moveable contact of the circuit breaker from the CLOSED to the OPEN position, the profile of the rotary crank means may include a first portion adapted to exert a lever action on the second end of the shaft means during rotation of the rotary crank means through the first predetermined angle.

The profile of the rotary crank means advantageously further includes a second portion adjacent the first portion the second portion comprising a sector having a constant radius over an angle at least substantially equal to the second predetermined angle, whereby the moveable contact of the circuit breaker is maintained in the OPEN position during the further rotation of the rotary crank means through the second predetermined angle.

Conveniently, the means for rotating the rotary crank means comprises a link attached to the rotary crank means at a fixed radial distance from the center of rotation of the rotary crank means.

The moveable contact of the disconnector may comprise a contactor link hinged at one end thereof to fixed contact means so that an opposing free end of the contactor link can be moved into and out of engagement with further fixed contact means thereby respectively to CLOSE and OPEN the disconnector. This may be achieved by pivotally connecting the contactor link at a location between its hinged end and its tree end to an end of the insulating linkage which at an opposed end thereof is pivotally connected to the rotary crank means at a location thereon which is a fixed radial distance from the center of rotation of the rotary crank means and a fixed angular distance from the first portion of the profile of the rotary crank means.

The shaft means is conveniently also part of an actuator element of the autorecloser for automatically driving the moveable contact of the circuit breaker into its OPEN and CLOSED states.

BRIEF DESCRIPTION OF THE DRAWINGS

Embodiments of the invention will now be described by way of example only, with reference to the accompanying drawings, in which.

DETAILED DESCRIPTION OF THE PREFERRED EMBODIMENTS

Figure 1:
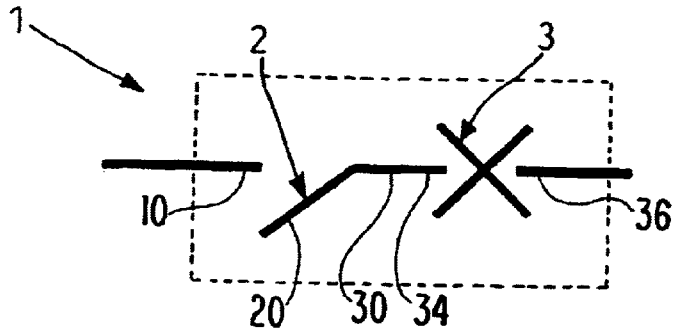
FIG. 1 is a single line electrical diagram of the connections for an autorecloser comprising a circuit breaker and a disconnector in series.
Figure 2:
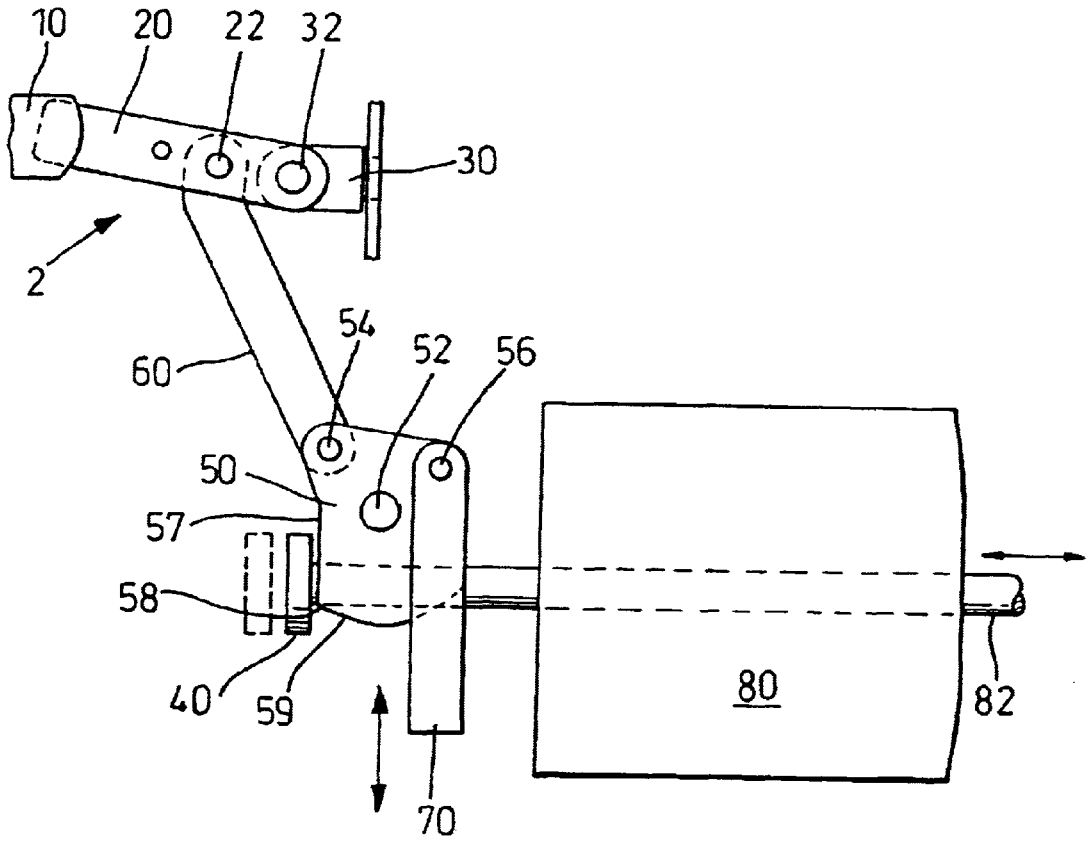
FIGS. 2, 3A and 4 show three different positions of an operating linkage in accordance with the present inventions for use in association with the autorecloser of FIG. 1.

In FIG. 1, an autorecloser 1 comprises a disconnector 2 in series with a circuit breaker element 3 The circuit breaker 3 and the disconnector 2 are integrated with each other in that they are provided with mechanical and electrical interlocks to prevent on-load operation of the series disconnector 2, because as explained above, it is an off-load switching device. The present invention as described below in relation to FIGS. 2 to 4 provides the required mechanical interlock system.

The interlock system must meet some important criteria, as follows;

(1) A local manual opening operation should automatically fully open the autorecloser circuit breaker contacts, with the disconnector contacts held in full electrical contact, before moving the disconnector to the OPEN position.

(2) With the autorecloser circuit breaker contacts CLOSED, it must not be possible to move the disconnector contacts from a position where they have fill electrical contact without first opening the circuit breaker.

(3) The disconnector should be free to be opened when the autorecloser circuit breaker contacts are OPEN.

(4) The autorecloser circuit breaker contacts will only be free to close when the disconnector is closed and its contacts have full electrical contact.

(5) When the disconnector is being operated toward the CLOSED and OPEN positions. and when in the OPEN position it must not be possible to close the autorecloser circuit breaker contacts.

Referring now to FIG. 1 and FIG. 2, there is shown an operating mechanism according to the invention. In the mechanism, a series disconnector 2 has fixed contacts 10, 30 and a moving contact 20 which is hinged to the fixed contact 30 by a hinge pin 32. Fixed contact 10 is connected to the electrical power circuit via bushings, not shown, and fixed contact 30 is rigidly connected to a fixed contact of the circuit breaker, not shown, via electrical bushings, also not shown. The power electrical path through the unit is therefore through external electrical bushings, the disconnector fixed contact 10, the disconnector moving contact 20, the disconnector fixed contact 30, the circuit breaker fixed contact 34, the circuit breaker movable contact 36, and a final set of external bushings, not shown.

The autorecloser circuit breaker 3. see FIG. 1, is mechanically linked to the drive element 80. Drive element 80 may be of the magnetic actuator type In the embodiment shown in FIG. 2, drive element 80 is directly connected through drive shaft 82 at its right hand side to the autorecloser circuit breaker, thereby to OPEN and CLOSE the circuit breaker contacts by a linear backwards and forwards motion between two fixed positions, as indicated by a double-headed arrow. Drive shaft 2 also extends through the center of the drive element 80 to emerge at its left hand side. Drive shaft 82 has a flanged end 40 at its left hand extremity, the back face of which is intended to engage with a bell crank 50. This bell crank is arranged to rotate on a fixed axis pin 52 and is connected through radially outer pivot point 54 to a drive link 60 manufactured from insulating material. The remote end of drive link 60 is connected to the disconnector moving contact 20 through pivot 22 about a third of the way along the length of contact 20 from fixed hinge pin 32. The arrangement is such that rotation of the bell crank 50 will cause the disconnector contact 20 to move towards the OPEN or CLOSED position depending upon the direction of rotation of bell crank 50.

Also connected to bell crank 50 at a radially outer pivot point 56 is a link 70. which is arranged to move up and down in a vertical direction as shown by the double-headed arrow Link 70 is the means by which manual operation of the disconnector 2 is carried out. Upward movement of link 70 causes the bell crank 50 to move in an anti-clockwise direction. while downward movement causes clockwise bell crank movement.

As seen in FIGS. 2 to 4, the bell crank 50 is provided with a special two-part cam profile for engagement with the flange 40 of shaft 82. A first part 57 of the cam profile is straight, ending at a corner 58. A second part 59 extends from comer 58 as a curve of constant radius centered on the axis of the fixed pivot 52.

The mechanism in FIG. 2 is shown in the position which it adopts when both the series disconnector 2 and the autorecloser circuit breaker 3 are in the CLOSED position, the disconnector moving contact 20 being in fill electrical contact with fixed contact 10. Starting from this position, with the straight part 57 of the cam profile lying parallel to the rear face of flange 40, downward movement of the link 70 rotates the bell crank 50 clockwise causing its bottom left corner 58 to engage the rear face of flange 50 at the left end of drive shaft 82. As the rotation of bell crank 50 continues, the corner 58 of the cam profile exerts a lever action on flange 40 so that it is pushed to the position shown in dotted outline, this being the position it assumes when the autorecloser circuit breaker is in the OPEN position.

Figure 3A:
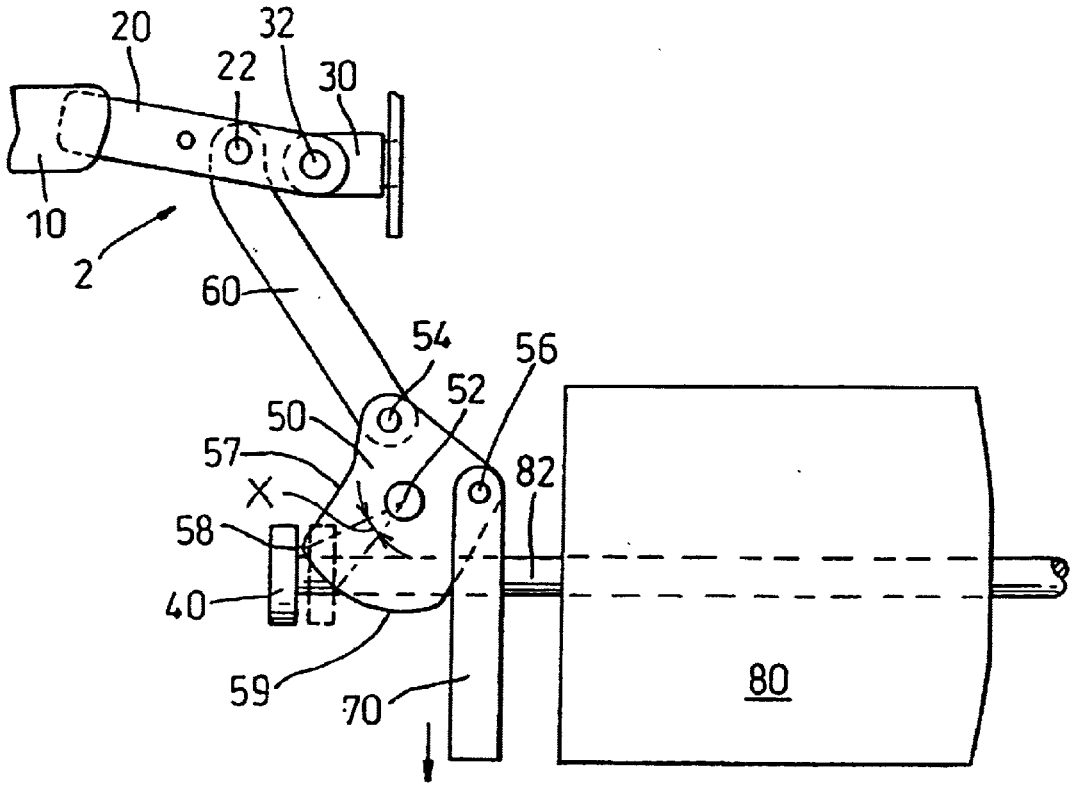
Figure 3B:
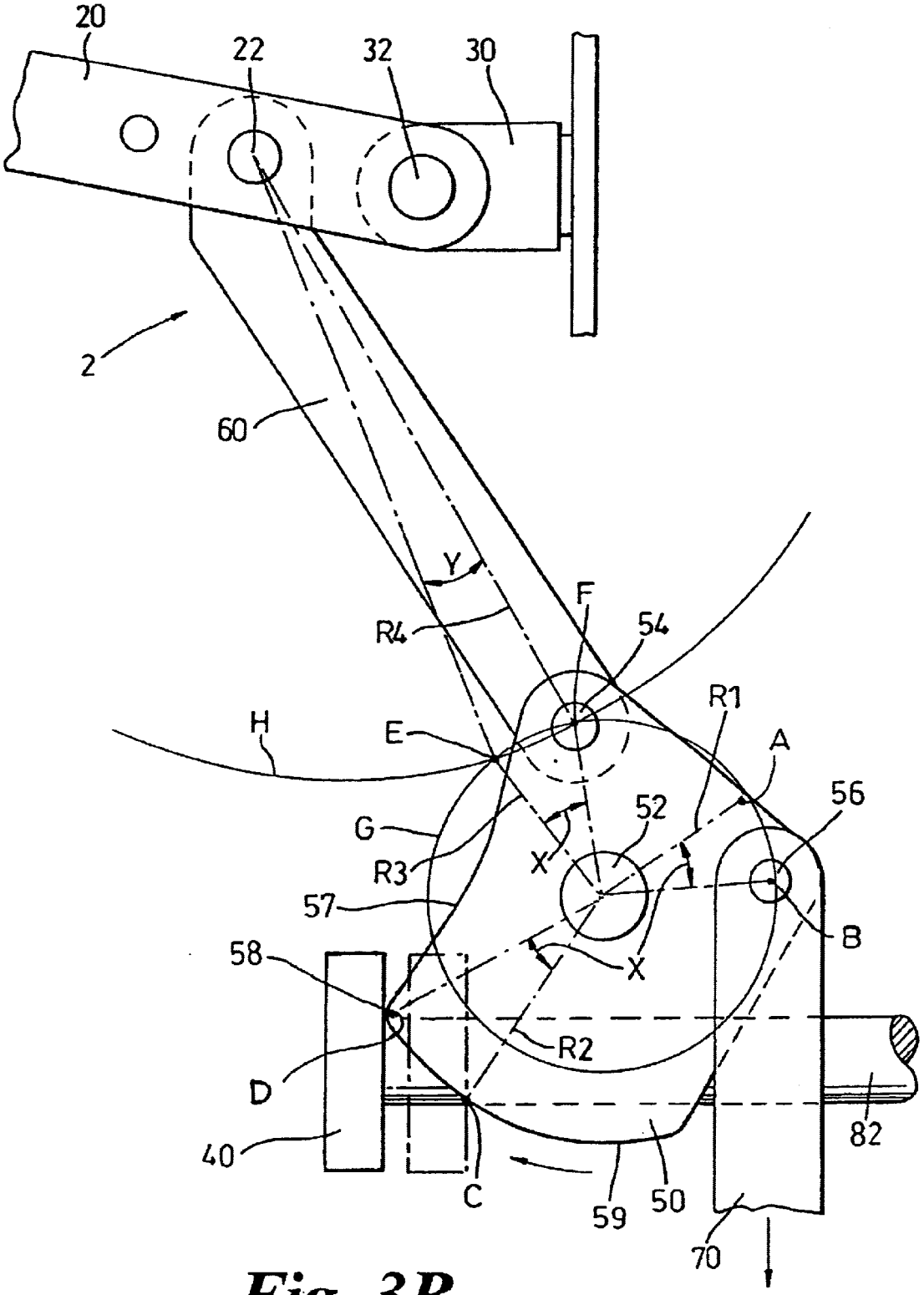
FIG. 3B is an enlargement of part of FIG. 3A illustrating the motions of the mechanism during the transition between the positions of FIGS. 2 and 3A.

FIG. 3. illustrates the configuration of the entire mechanism when the circuit breaker is in the OPEN position, the starting position of flange 40 in FIG. 2 being shown in dashed lines. It will be noticed that even though the bell crank 50 has been angularly rotated through about 30 degrees, the movable contact 20 is still in substantially the same position it was in FIG. 2 i.e. the disconnector 2 is still in the CLOSED condition. FIG. 3B illustrates the reason for this more clearly.

It will be seen from FIG. 3B that as link 70 is pulled down, the center of pivot pin 56 on radius R1 moves from position A to position B, through an angle of X degrees Angle X was designated as about 30 degrees in the preceding paragraph, though this angle and other dimensional characteristics of the mechanism can of course be varied to suit any particular design requirements. Similarly, point 58 on radius R2 moves through angle X from position C to position D, pushing flange 40 to the left and the center of pivot pin 54 on radius R3 moves through angle X from point E to point F. At the same time it can be seen that the line R4 extending between the centers of pivot pins 72 and 54 has moved through an angle Y. If a circle G centered on the center of fixed pivot pin 52 is drawn through points E and F and a circle H centerd on the center of pin 22 on moveable contact 20 is also drawn through points E and F, it will be noted that there is only a very small overlap of the circles indicating that there is little movement of the pivot 22 relative to the fixed pin 52. Hence, moveable contact 20 does not move out of engagement with fixed contact 10 as the circuit breaker moves from the CLOSED position in FIG. 2 to the OPEN position in FIG. 3A, fulfilling the above criteria (1) and (2).

Figure 4:
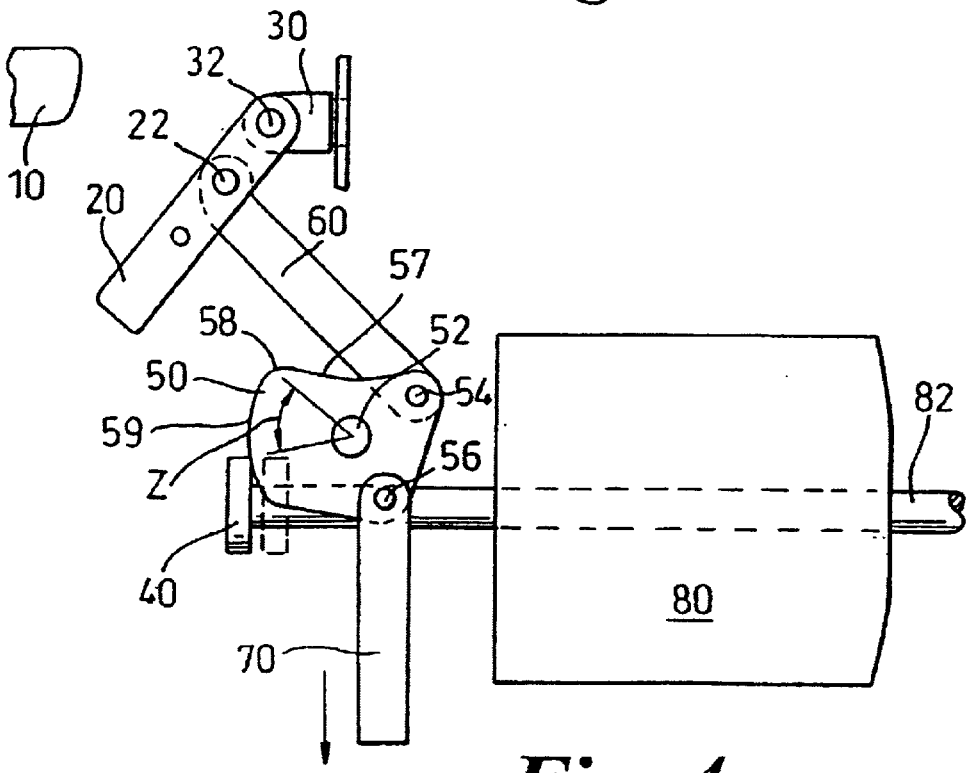

At the point shown in FIGS. 3A and 3B, further downward movement of the link 70 will bring the rear face of flange 40 into contact with the second part 59 of the cam profile on bell crank 50 as it rotates further clockwise. This cam face 59 is of constant radius, thereby maintaining the drive shaft 82 in the same position so that the circuit breaker cannot CLOSE. At the same time, as pivot pin 54 moves clockwise around circle G. link 60 pulls moveable contact 20 down and away from fixed contact 10. so moving it to the OPEN position as shown in FIG. 4. This fulfils criterion (3), above.

It will now be seen from FIG. 4 that further downward pulling of link 70, if allowed. could only rotate the bell crank 50 further clockwise by a limited amount, at most until pivot pin 56 is directly underneath flxed pivot 52. At this point, cam face 59 would still be in contact with flange 40, again ensuring that flange 40 is prevented from moving towards the CLOSED position. However, it is in fact arranged that after flange 40 has begun to engage cam face 59, the bell crank 50 can only be rotated through a further angle Z to a predetermined limit of movement, so that after movement through angle Z has been achieved, further clockwise rotation of the bell crank 50 from the position shown in FIG. 4 is prevented. Hence, criterion (5) above is filled because the disconnector contact 20 is mechanically tree to be driven back co the CLOSED position by upward movement of drive link 70, causing the bell-crank 50 to rotate anti-clockwise and thus drive the insulating link 60 upwards.

Prevention of further rotary movement of bell crank 50 after it has turned through the angle X÷Z can readily be achieved by means of a suitable stop in the mechanism; for instance, an abutment may be arranged between a lug (not shown) on the bell crank 50 and a further lug (not shown) on a stationary support structure.

Clearly, there is nothing in this invention which prevents the additional use of electrical interlocks and/or auxiliary switches to help in meeting the operational requirements listed, and it would be prudent to have such devices. However, this invention will ensure the requirements are always met, even in the event of loss of electrical power to the operating mechanism.

Although link 70 has been described as the means by which manual operation of the disconnector 2 is carried out, the invention is not restricted to such manual operation. Clearly, it is at the option of the designer also to connect the link 70 to a linear magnetic actuator or a motorised rack-and-pinion mechanism, for example, in order to provide for remote or automatic operation of the disconnector in addition to provision of manual operation as a last resort.

What is claimed is:

1. An operating mechanism for mechanically interlocking a movable breaker contact of a circuit breaker of an autorecloser with a movable disconnector contact of a disconnector in electrical series with the circuit breaker to prevent on-load operation of the disconnector, the mechanism comprising:

a) a drive shaft having first and second shaft portions in a force transmitting relationship, the first shaft portion being operatively connected to the breaker contact to move the same between open and closed breaker positions;

b) a crank turnable in either circumferential direction about a crank axis, the crank having a cam surface in force-transmitting relationship with the second shaft portion;

c) a drive link operatively connected between the crank and the disconnector contact to move the same between open and closed disconnector positions; and d) an arm connected to the crank for turning the same in one circumferential direction about the crank axis from a starting position in which both movable contacts are in their respective closed positions through a first angular distance to an intermediate position in which the cam surface of the crank moves the second shaft portion to move the breaker contact to the open breaker position while the disconnector contact is maintained in the closed disconnector position, said arm being further operative for turning the crank along said one circumferential direction from the intermediate position through a second angular distance to an ending position in which the crank moves the drive link to move the disconnector contact to the open disconnector position while the cam surface of the crank maintains the breaker contact in the open breaker position, said arm being still further operative for turning the crank in an opposite circumferential direction opposite to said one circumferential direction about the crank axis from the ending position past the intermediate position to the starting position during which the crank moves the disconnector contact back to the closed disconnector position before the breaker contact is moved back to the closed breaker position.

2. The mechanism of claim 1, wherein the second shaft portion is an end flange.

3. The mechanism of claim 1, wherein the crank axis is fixed, and wherein the drive link is connected to the crank at a pivot located radially outwardly of the fixed crank axis.

4. The mechanism of claim 1, wherein the crank axis is fixed, and wherein the arm is connected to the crank at a pivot located radially outwardly of the fixed crank axis.

5. The mechanism of claim 1, wherein the drive link is constituted of an insulating material.

6. The mechanism of claim 1, wherein the arm has a manually operated handle.

7. The mechanism of claim 1, wherein the cam surface has a first straight part in engagement with the second shaft portion in the starting position.

8. The mechanism of claim 7, wherein the cam surface has a corner part in force-transmitting relationship with the second shaft portion and for exerting a lever action on the second shaft portion during turning of the crank through the first angular distance.

9. The mechanism of claim 8, wherein the cam surface has a second curved part having a constant radius of curvature in engagement with the second shaft portion during turning of the crank through the second angular distance.

10. The mechanism of claim 9, wherein the corner part is located between the first and second parts of the cam surface.

11. The mechanism of claim 1, wherein the disconnector contact comprises a hinged contactor link having opposite ends, and wherein the drive link is pivotably connected to the contactor link at a pivot point intermediate the ends of the contactor link.

* * * * *